US005611259A

United States Patent [19]

Nagata

[11] Patent Number: 5,611,259

[45] Date of Patent: Mar. 18, 1997

[54] HYDRAULIC CIRCUIT FOR DRIVING A RAM OF HYDRAULIC PRESS

[75] Inventor: Takeshi Nagata, Aichi, Japan

[73] Assignee: Nisshinbo Industries, Inc., Tokyo, Japan

[21] Appl. No.: 539,528

[22] Filed: Oct. 6, 1995

[30] Foreign Application Priority Data

Oct. 25, 1994 [JP] Japan ..... 6-285896

[51] Int. Cl.[6] ..... F15B 15/17; F15B 11/04

[52] U.S. Cl. ..... 91/415; 91/435; 91/437; 91/458; 60/494

[58] Field of Search ..... 91/47, 421, 415, 91/437, 435, 436, 458, 461; 60/395, 494

[56] References Cited

U.S. PATENT DOCUMENTS

| | | | |
|---|---|---|---|
| 2,683,966 | 7/1954 | Tyler | 91/421 X |
| 3,685,531 | 8/1972 | Byford | 91/421 X |
| 4,342,256 | 8/1982 | Andersen et al. | 91/435 X |
| 4,680,929 | 7/1987 | Mouri et al. | 60/395 X |
| 4,819,541 | 4/1989 | Pitsch et al. | 91/421 X |
| 5,007,544 | 4/1991 | Saotome et al. | 91/437 X |

*Primary Examiner*—Hoang Nguyen

*Attorney, Agent, or Firm*—Ronald J. Kubovcik, Esq.; James C. Lydon, Esq.

[57] ABSTRACT

The hydraulic circuit directional control valve 20 is provided in a line connected with a lower chamber 13 of the hydraulic cylinder 1 and the B-port of the servo valve 3. A check valve 22 permitting oil flowing into the P-port of the servo valve 3 from the lower chamber 13 is provided in the line in parallel with the hydraulic circuit directional control valve 20 and connected with the lower chamber 13 and the P-port of the servo valve 3. When making the ram 15 move downward with high speed, the hydraulic differential circuit is constituted by changing the hydraulic circuit directional control valve 20 such that the delivery oil exhausted from the lower chamber 13 returns to the P-port of the servo valve 3. The hydraulic oil supplied from the hydraulic pump 1 flows into the upper chamber 12 through the servo valve 3. The delivery oil exhausted from the lower chamber 13 returns to the suction side of the P-port of the servo valve 3 through the check valve 22, assisting the flow rate of the hydraulic pump 2.

3 Claims, 3 Drawing Sheets

HYDRAULIC CIRCUIT FOR DRIVING A RAM OF HYDRAULIC PRESS

BACKGROUND OF INVENTION

The present invention relates to a hydraulic circuit for driving a ram of hydraulic press.

In general, a hydraulic circuit using such as a 4-ports spool valve and a directional control valve has applied for driving a ram of a hydraulic press. Especially it has been made use of a servo valve for operating the ram with high speed.

In such the hydraulic circuit, a servo valve is provided in a line connecting a hydraulic cylinder and a variable displacement hydraulic pump. The hydraulic pump is driven by a motor for absorbing oil from a oil tank to store up the hydraulic oil into an accumulator. The hydraulic pump supplies hydraulic oil to a P-port of the servo valve. At the delivery side of the hydraulic pump, a pressure reducing valve is connected. The reducing output pressure of the pressure reducing valve is to be equal to the pilot pressure of the servo valve, whose A-port is connected with the upper chamber of the hydraulic cylinder, and whose B-port is connected with the lower chamber of the hydraulic cylinder, respectively. The T-port of the servo valve is linked with the oil tank. Supplying and filling up the upper chamber or the lower chamber of the hydraulic cylinder with the pressure oil, the ram fixed the rod of the hydraulic cylinder is to be moving upward or downward.

Considering the case of stamping out a work in the stamping machining process adopting this hydraulic circuit. When acting a load on the ram under the feed back control detecting a position of the ram, the opening rate of the servo valve is large so that in the instance of having stamped out a work the load acting on the ram is decreasing rapidly. Then the ram is running by inertia so that it is easy to give rise to an over-shoot. As a result, using this hydraulic circuit, there is a problem that this over-shoot causes to an increase of moving distance of the ram and a dead time when operating the ram with high speed.

Considering the case of the form machining process such as a drawing machining. In this machining, it is impossible to hold a constant pressure in the lower chamber of the hydraulic cylinder. As a result, there is a problem that it is difficult to assure the positioning control of the bottom dead center of the ram with high accuracy.

There is an essential problem that in order to drive the ram of the hydraulic press using a servo valve with high speed operation, it is necessary for a servo valve with high response and with large amount flow rate and a hydraulic pump with large amount flow rate, so that the energy efficiency becomes bad.

The present invention has as its purpose the solution of the above mentioned problems. It is the purpose of the present invention to offer a HYDRAULIC CIRCUIT FOR DRIVING A RAM OF HYDRAULIC PRESS which can control a hydraulic cylinder driving the ram of the hydraulic press with high speed and with good efficiency and which can operate with a heavy load.

The purpose of the present invention is to offer a hydraulic circuit for driving a ram of hydraulic press which is able to prevent the ram from running by inertia in the stamping machining process and which is able to assure the positioning accuracy of the bottom dead center of the ram and which it is easy to control using a control equipment such as a NC controller.

SUMMARY OF THE INVENTION

In order to attain the above mentioned purposes, a hydraulic circuit for driving a ram of hydraulic press of the present invention comprises: a main hydraulic circuit for connecting with a hydraulic cylinder for driving the ram of the hydraulic press and a hydraulic pump for supplying hydraulic oil to the hydraulic cylinder; a servo valve for controlling the supply of the hydraulic oil; a hydraulic circuit directional control valve for opening and shutting a hydraulic line to which a rod side chamber of the hydraulic cylinder and the servo valve are connected, the rod side chamber is connected with the ram such that the hydraulic oil flows into the main hydraulic circuit at the rod side chamber; a hydraulic differential line being arranged in parallel with the hydraulic line to which a hydraulic circuit directional control valve is provided; a check valve being provided in the hydraulic differential line; whereby; constituting a hydraulic differential circuit by shutting the hydraulic circuit directional control valve when operating the ram with high speed; opening said hydraulic circuit directional control valve when operating said ram with a heavy load.

The hydraulic circuit for driving a ram of hydraulic press according to the present invention achieves the followings, that is, preventing the ram's running by inertia and holding the ram's bottom dead center positioning with high accuracy by using the same capacity hydraulic pump and the servo valve, and operating a machining process to control the hydraulic cylinder with high speed and high accuracy and with a full and heavy load in comparable to the conventional hydraulic circuit. Thus the energy efficiency being good to operate a machining process in case of gaining the machining frequency in order to attain its aim.

The hydraulic circuit directional control valve may be a two-ports electromagnetic directional control valve. The two-ports electromagnetic directional control valve and the servo valve are selectively controlled by an external control equipment such as a NC controller, by calculating an acting oil pressure from a material and a thickness of a work to be machined and from information of dies being registered in the external control equipment.

The hydraulic circuit for driving a ram of hydraulic press according to the present invention achieves the followings, that is, selecting the optimum hydraulic circuit to control by using an external control equipment. Thus it is possible to calculate automatically some machining conditions of a stamping machining and a drawing machining.

DETAILED DESCRIPTION OF THE PREFERRED EMBODIMENT

The description of the preferred embodiments of the present invention will now be explained hereinafter in detail by figures.

Prior to explain an embodiment of the present invention, a conventional type of a hydraulic circuit for driving a ram using servo valves will be explained referring FIG. 3.

Figure 3:
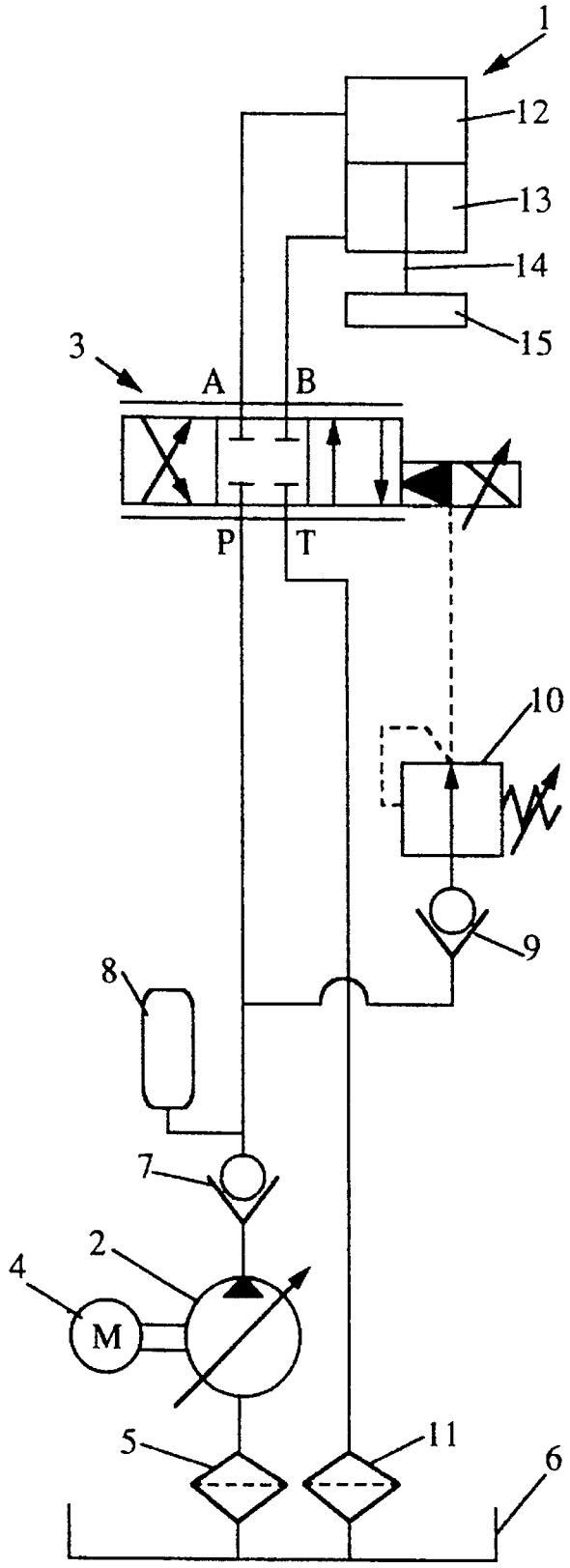
FIG. 3 shows a conventional type of a hydraulic circuit of a ram driving by using a servo valve.

In FIG. 3, number 1 is a hydraulic cylinder, number 2 is a variable displacement hydraulic pump, and a servo valve 3 is provided a hydraulic line connected with them. The hydraulic pump 2 driven by a motor 4 absorbs oil from a oil tank 6 through a strainer 5, and stores up the hydraulic oil into an accumulator 8, and supplies the P-port of the servo valve 3 with the hydraulic oil through a check valve 7. The delivery side of the check valve 7 is connected with a pressure reducing valve 10 through a check valve 9. The reducing output pressure of the pressure reducing valve 10 is to be equal to the pilot pressure of the servo valve 3, whose A-port is connected with the upper chamber 12 of the hydraulic cylinder 1, and whose B-port is connected with the lower chamber 13 of the hydraulic cylinder 1, respectively. The T-port of the servo valve 3 is linked with the oil tank 6 through a strainer 11. Supplying and filling up the upper chamber 12 or the lower chamber 13 with the pressure oil, the ram 15 fixed the rod 14 of the hydraulic cylinder 1 is to be moving upward or downward.

In this hydraulic circuit, setting up the linkage pattern of the servo valve 3 with the right-hand pattern as in the FIG. 3, the hydraulic oil supplied from the hydraulic pump 2 flows into the upper chamber 12 of the hydraulic cylinder 1 through the servo valve 3, and the delivery oil exhausted from the lower chamber 13 of the hydraulic cylinder i returns to the oil tank 6 through the servo valve 3. The rod 14 is made push downward and the ram 15 is to be moving downward.

On the other hand, when the ram 15 moves upward, the linkage pattern of the servo valve 3 is set up with the left-hand linkage in FIG. 3. The hydraulic oil supplied from the hydraulic pump 2 flows into the lower chamber 13 through the servo valve 3 and the delivery oil exhausted from the upper chamber 12 of the hydraulic cylinder 1 returns to the oil tank 6 through the servo valve 3. The rod 14 is made push upward and the ram 15 is to be moving upward.

The pressure force F acting on the ram 15 is given by the equation, $F=A1\times P$, where A1 is the cross-section of the upper chamber 12 of the oil cylinder 1, P is the supply oil pressure of the hydraulic oil. The downward velocity V1 of the ram 15 is obtained from the equation, $V1=Q/A1$, where Q is the flow rate of the hydraulic oil supplied from the hydraulic pump 2. The upward velocity V2 is obtained from the following equation, $V2=Q/A2$, where A2 is the cross-section of the lower chamber 13 of the hydraulic cylinder 1 except for the cross-section of the rod 14.

Considering the case of stamping out a work in the stamping machining process adopting this hydraulic circuit, when acting a load on the ram 15 under the feed back control detecting a position of the ram 15 by sensors, the opening rate of the servo valve 3 is large so that in the instance of having stamped out a work the load acting on the ram 15 is decreasing rapidly. Then the ram 15 is running by inertia so that it is easy to give rise to an over-shoot. As mentioned above, using this hydraulic circuit, there is a problem that this over-shoot causes to an increase of moving distance of the ram 15 and a dead time when operating the ram 15 with high speed.

Considering the case of the form machining process such as a drawing machining, it is impossible to hold a constant pressure in the lower chamber 13 of the hydraulic cylinder 1. As mentioned above, there is a problem that it is difficult to assure the positioning control of the bottom dead center of the ram 15 with high accuracy.

Figure 1:
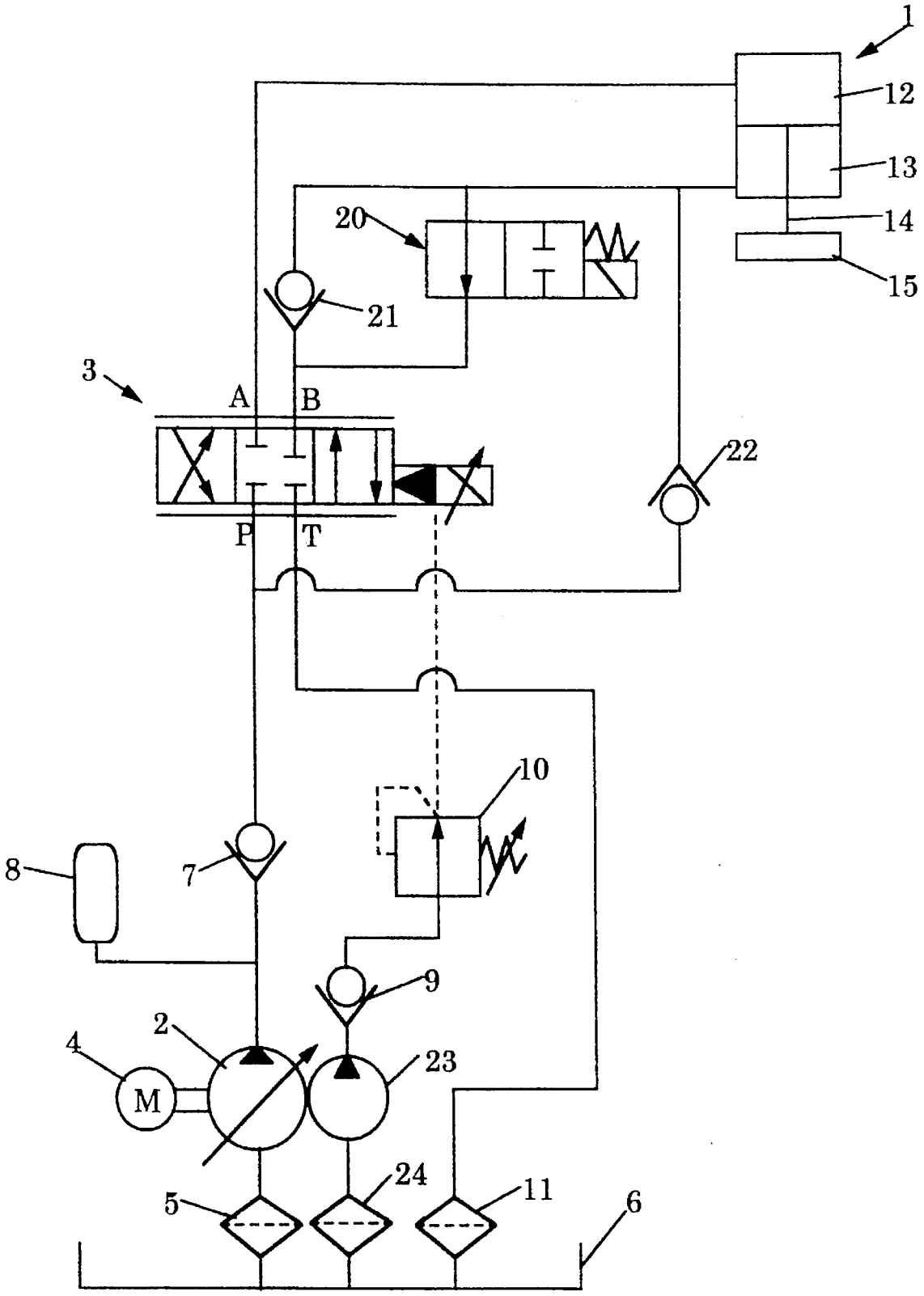
FIG. 1 shows a preferred embodiment of a hydraulic circuit of the present invention.

FIG. 1 shows a basic concept of a hydraulic circuit of a preferred embodiment of the present invention. In the present embodiment, the line connected with the lower chamber 13 of the hydraulic cylinder 1 and the B-port of the servo valve 3 has double line system. In one line, a hydraulic circuit directional control valve 20 which makes use of a two ports electromagnetic valve is provided. In the other line, a check valve 21 is set up, the oil flowing into the lower chamber 13 of the hydraulic cylinder 1 from the servo valve 3.

The line connected with the lower chamber 13 of the hydraulic cylinder 1 and the P-port of the servo valve 3 is arranged in parallel with the line included the hydraulic circuit directional control valve 2 and the check valve 21. In this line a check valve 22 is provided, the oil flowing into the P-port of the servo valve 3 from the lower chamber 13.

In the present embodiment a double hydraulic pump system is adopted, a hydraulic pump 23 with small flow rate supplies the servo valve 3 with pilot hydraulic oil through the check valve 9 and the pressure reducing valve 10. The suction side of the hydraulic pump 23 is linked with the oil tank 6 through the strainer 24.

The operation of the present embodiment will now be explained hereinafter. At first, the high speed operation will be explained. In this case, setting up the linkage pattern of the hydraulic circuit directional control valve 20 with the right-hand pattern as shown in FIG. 1, the hydraulic differential line comprises that the delivery oil exhausted from the lower chamber 13 of the hydraulic cylinder 1 returns the P-port of the servo valve 3. In order to make the ram 15 move downward, the linkage pattern of the servo valve 3 is set up with the fight-hand pattern in FIG. 1. The hydraulic oil supplied from the hydraulic pump 1 flows into the upper chamber 12 through the servo valve 3. The delivery oil exhausted from the lower chamber 13 returns the suction side of the P-port of the servo valve 3 through the check valve 22, and assists the flow rate of the hydraulic pump 2, and supplies the upper chamber 12 of the hydraulic cylinder 1. On the other hand, making the ram 15 move upward, the linkage pattern of the servo valve 3 is set up with the left-hand pattern of the servo valve 3 in FIG. 1. The lower chamber 13 of the hydraulic cylinder 1 is supplied with the hydraulic oil through the check valve 21. The delivery oil exhausted from the upper chamber 12 returns to the oil tank 6 through the servo valve 3.

In the hydraulic circuit as shown in FIG. 1, the pressure force F is obtained from the equation, $F=(A1-A2)\times P=A3\times P$, where A3 is the cross-section of the rod 14. The downward velocity V1 of the ram 15 is calculated from the equation, $V1=Q/A3$, the upward velocity V2 of the ram 15 is calculated from the equation, $V2=Q/A2$, respectively. As a result, using the conventional hydraulic circuit and the hydraulic pump with the same capacity as shown in FIG. 3, the downward velocity V1 ($=Q/A3:A3<A1$) of the present embodiment is larger than the downward velocity V1 ($=Q/A1$) of the conventional hydraulic circuit, the velocity increment corresponds to the oil volume exhausted from the lower chamber 13 of the hydraulic cylinder 1. Using this hydraulic circuit, it hardly causes the phenomenon of the ram 15 running by inertia when the load acting on the ram 15 decreases rapidly, because of holding the back pressure at the lower chamber 13 of the hydraulic cylinder 1 in the stamping machining process. As a result, it is possible to operate with higher speed as compared with using the conventional hydraulic circuit, because of no dead time of the running by inertia of the ram 15 and because of the downward velocity of the ram 15 being larger. In the case of the form machining process such as a drawing machining, it makes practical use of the positioning control with high accuracy because of holding a constant pressure at the lower chamber 13 of the hydraulic cylinder 1.

The operation of the heavy load machining will be explained. In this case, setting up the linkage pattern of the hydraulic circuit directional control valve 20 with the left-hand pattern in FIG. 1, and setting up the linkage pattern of the servo valve 3 with the right-hand pattern like as a conventional hydraulic circuit, supplying the hydraulic cylinder 1 with the hydraulic oil from the hydraulic pump 2, the ram 15 is moved downward. In a similarly way, the ram 15 is moved upward.

In the actual machining by using the present embodiment, by calculating automatically an acting oil pressure from a material and a thickness of a machining work and from a die registered by NC controller, it automatically selects the hydraulic circuit to be necessary. In the form machining process such as a drawing machining to be necessary for the positioning control with high accuracy, judging automatically by the NC controller, it makes choice of whether the hydraulic circuit is set up with the differential hydraulic circuit. If the hydraulic circuit directional control valve 20 is out of order, the maximum machining capacity of the hydraulic press is assured because that the other hydraulic circuit components are able to operate as the conventional hydraulic circuit.

The example of applying a turret punch press with the HYDRAULIC CIRCUIT FOR DRIVING A RAM OF HYDRAULIC PRESS adopting the present invention will be explained. The turret punch press has a good characteristics that it is possible to operate a different machining in character such as a stamping machining with a high frequency and with a full and heavy load, and it is possible to operate a form machining like as a drawing machining by the same machine. It is possible for the turret punch press to confirm the great use for the present invention.

Figure 2:
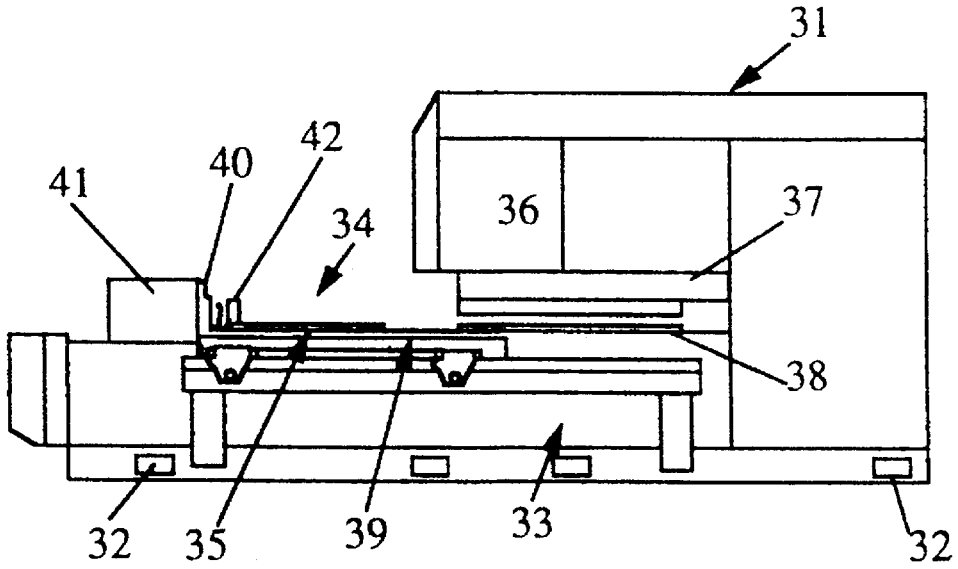
FIG. 2 shows a side view of a turret punch press adopting the hydraulic circuit for driving a ram of hydraulic press of the present invention.

The components of the turret punch press are discussed below. As shown in FIG. 2, the main body 31 of the turret punch press provides a frame body which is made up a frame 33 with multiple legs 32. In the working area 34 which is the fight-hand side in FIG. 2, the punching part 36 applied to a punching machining operation on a plate 35 is set up.

The punching part provides a disklike upper turret 37 loading above the frame 33 with its rotating freely and a disklike lower turret 38 loading on the frame 33 with its rotating freely and being opposed to the upper turret 37 at a distance. The upper turret 37 provides multiple punching tools with loading and unloading freely as it is not illustrated. The upper turret 37 and the lower turret 38 are to rotate in the same rotational direction with synchronized operation by the turret driving device as it is not illustrated, and are able to stop at an appointed position. The punch tool loading on the upper turret 37 is able to move upward and downward by the ram driving device fixed on the frame as it is not illustrated, and to operate punching machining by the ram 15 as it is not illustrated.

The table 33 putting on a plate 35 is loaded on the upper part of the under side of the frame 33. The carriage 40 is loaded with its sliding freely in the same direction of the longitudinal direction of the carriage base 41. Multiple work clamps are loaded as possible to move or to be fixed in the moving direction of the carriage 40. As a result, it is possible to apply to a punching machining operation on the plate 35 whose endpart is clamped by the work clamp 42 putting on the table 39 by the punching part 36.

The experiments by the inventors show the following results. By using the turret punch press, the punching number by the conventional hydraulic circuit is 220 times per minute, and the punching number by the hydraulic circuit adopting the present invention is 340 times per minute, respectively. The increase of the punching capacity is approximately 50 percents. In the case of the drawing machining to need the positioning with high accuracy, the positioning accuracy of the bottom dead center of the ram by the conventional hydraulic circuit is 0.1 mm, the one by the present invention is within 0.05 mm.

We claim:

1. A hydraulic circuit for driving a ram of hydraulic press comprising:

a main hydraulic circuit for connecting with a hydraulic cylinder for driving the ram of the hydraulic press and a hydraulic pump for supplying hydraulic oil to the hydraulic cylinder;

a servo valve for controlling the supply of the hydraulic oil;

a hydraulic circuit directional control valve for opening and shutting a hydraulic line to which a rod side chamber of the hydraulic cylinder and the servo valve are connected, the rod side chamber is connected with the ram such that the hydraulic oil flows into the main hydraulic circuit at the rod side chamber;

a hydraulic differential line being arranged in parallel with the hydraulic line to which a hydraulic circuit directional control valve is provided;

a check valve being provided in the hydraulic differential line; whereby;

constituting a hydraulic differential circuit by shutting the hydraulic circuit directional control valve when operating the ram with high speed;

opening said hydraulic circuit directional control valve when operating said ram with a heavy load.

2. A hydraulic circuit for driving a ram of hydraulic press according to claim 1, wherein:

the hydraulic circuit directional control valve is a two-ports electromagnetic directional control valve;

the two-ports electromagnetic directional control valve and the servo valve are selectively controlled by an external control equipment, by calculating an acting oil pressure from a material and a thickness of a work to be machined and from information of dies being registered in the external control equipment.

3. The hydraulic circuit of claim 2, wherein said external control equipment comprises a numerical control controller.

* * * * *